US005457437A

United States Patent [19]

Kim

[11] Patent Number: 5,457,437

[45] Date of Patent: Oct. 10, 1995

[54] SPARKING FREE CIRCUIT OF ELECTRIC HORN

[75] Inventor: Young S. Kim, Seoul, Rep. of Korea

[73] Assignee: Mando Machinery Corporation, Kyungki-do, Rep. of Korea

[21] Appl. No.: 100,678

[22] Filed: Aug. 2, 1993

Related U.S. Application Data

[63] Continuation-in-part of Ser. No. 812,804, Dec. 23, 1992, abandoned.

[30] Foreign Application Priority Data

Aug. 6, 1991 [KR] Rep. of Korea ..... 91-8435 U
Aug. 6, 1991 [KR] Rep. of Korea ..... 91-8436 U
Aug. 6, 1991 [KR] Rep. of Korea ..... 91-8437 U

[51] Int. Cl.[6] ..... G08B 3/00

[52] U.S. Cl. ..... 340/384.1; 340/388.1; 340/388.7; 340/393.2; 340/398.2; 340/397.3; 116/137 R

[58] Field of Search ..... 340/384.1, 388.1, 340/388.2, 388.7, 393.2, 393.3, 398.2, 397.3; 116/24, 137 R, 142 R

[56] References Cited

U.S. PATENT DOCUMENTS 3,931,549 1/1976 Berns et al. ..... 340/384 E
3,945,004 3/1976 Myers ..... 340/384 R
4,139,842 2/1979 Fujita et al. ..... 340/384 R
4,199,752 4/1980 Lucas et al. ..... 340/388

*Primary Examiner*—Donnie L. Crosland
*Attorney, Agent, or Firm*—Vineet Kohli; Thomas R. Morrison

[57] ABSTRACT

An electric horn which comprises a diaphragm held at its peripheral portion in a housing of the horn and having an armature attached to a middle portion thereof; an electromagnet having a coil and disposed adjacent to the armature in an opposed relationship with each other for causing the armature to move down under an action of a magnetic field produced by an energizing current flowing through said coil; an interrupter having a pair of normally-closed contacts including a fixed contact and a movable contact and connected at one contact to a DC power source; a horn actuating switch connected serially in circuit with the interrupter; and a sparking free circuit including at least one electronic triggering switching means connected to the coil, for interrupting the energizing current supply to the coil of the electromagnet; the normally-closed interrupter located near the armature and connected to a control input of the triggering switching means, for turning ON and OFF the triggering switching means, the movable contact engaging the armature so as to open the interrupter by the downward movement of the armature; a current limiting means connected serially with the interrupter. A capacitor is connected in parallel with the horn actuating switch for enabling the turning ON and OFF cycle of the triggering switching means to be repeated in a given period of time during which the electric current flowing through the coil of the electromagnet is gradually reduced in its level.

6 Claims, 3 Drawing Sheets

SPARKING FREE CIRCUIT OF ELECTRIC HORN

RELATED APPLICATION

This application is a continuation-in-part of application Ser. No. 07/812,804 filed Dec. 23, 1992 now abandoned.

BACKGROUND OF THE INVENTION

1. Field of the Invention

The present invention relates to an electric horn employed in a vehicle; and more particularly, to a spark free circuit of an electric horn capable of minimizing or removing an electric arc produced between the mechanical contacts in a horn actuating circuitry during the operation of the horn.

2. Prior Art

In general, an electric horn for use in a vehicle includes a horn actuating circuitry having mechanical contacts arranged therein. A typical electric horn has an interrupter connected serially in circuit with a coil of an electromagnet. Therefore, electric arc may be produced at the interface between the contacts of the interrupter especially when a high current, e.g., 5 amperes, flows through the serial connection of the interrupter and the coil of the electromagnet. Such an arcing condition induces an electromagnetic interference that may disturb or interfere with radio reception and affect adversely on the operation of the other electronic control circuits in the same vehicle.

Furthermore, such electric arc may result in burning-out on fusing-down of the contacts. This requires use of an expensive and high durability material in constructing the interrupter.

For example, as shown in FIG. 1, the electric horn comprises a diaphragm 10 held at its peripheral portion in a house of the horn having an armature 12 attached to a middle portion thereof, an electro-magnet 14 having a coil 16 and disposed adjacent to the armature 12 for causing the armature 12 to move downward under a magnetic field of the electromagnet 14, an interrupter 24 having a pair of normally-closed contacts 26 and 28 and connected at the contact 28 to a DC power source 18, the contacts 26 and 28 being opened by the downward movement of the armature 12, and a horn actuating witch 30 connected serially to the contact 26.

Accordingly, there have been proposed electric horns for suppressing such electric arc. For example, U.S. Pat. No. 4,568,995 discloses an electromagnetic interference suppression device for suppressing electric between the mechanical contacts of a vehicle horn actuating circuit. However, such device has a disadvantage in that there is not provided means for controlling an electric current to be supplied to the contacts at an appropriate level. Therefore, it has limited effectiveness in reducing the electric arc occurring at the mechanical contacts.

In Japanese Laid-Open Patent Publication No. 86-200045, there is provided an electric alarm capable of diminishing electric arc produced between the contacts of an interrupter during the operation of the alarm. However, in this device, since a horn actuating switch is connected serially in circuit with a coil of an electromagnet, a large quantity of current flows through the horn actuating switch, thereby creating an electric arcing condition at the interface between the contacts of the horn actuating switch.

On the other hand, in order to remove the electric arc across the contacts of the horn actuating switch, a horn relay may be used to channel a small quantity of current through the horn actuating switch. However, such addition of a horn device and a relatively high manufacturing cost. Furthermore, since the electromagnet is situated near the foremost of a vehicle, while the horn relay is located near the horn actuating switch which is positioned within a steering wheel, a lengthy conductor is required to connect the electromagnet with the horn actuating switch. As a result, the conductor acts as a source of an electromagnetic interference which frequently occurs from a high frequency signal, e.g., 400 Hz of 5 amperes, flowing therethrough, thereby disturbing or interfering with other electronic controls.

Accordingly, it is an object of the present invention to provide a sparking free circuit of an electric horn employed in a vehicle, which can remove or minimize an electric arc produced between the mechanical contacts of a horn actuating switch during the operation of the horn.

It is another object of the present invention to provide a sparking free circuit of an electric horn capable of reducing the current flowing through a horn switch with the electronic noise.

It is another object of the present invention to provide a sparking free circuit of an electric horn capable of producing soft sounds.

According to the present invention, there is provided an electric horn which comprises:

a diaphragm held at its peripheral portion in a housing of the horn and having an armature attached to a middle portion thereof;

an electromagnet having a coil and disposed adjacent to the armature in an opposed relationship with each other for causing the armature to move down under an action of a magnetic field produced by an energizing current flowing through said coil;

an interrupter having a pair of normally-closed contacts including a fixed contact and a movable contact and connected at one contact to a DC power source;

a horn actuating switch connected serially in circuit with the interrupter; and a sparking free circuit comprising;

at least one electronic triggering switching means connected to the coil, for interrupting the energizing current supply to the coil of the electromagnet;

the normally-closed interrupter located near the armature and connected to a control input of the triggering switching means, for turning ON and OFF the triggering switching means, the movable contact engaging the armature so as to open the interrupter by the downward movement of the armature;

a current limiting means connected serially with the interrupter.

A capacitor is connected in parallel with the horn actuating switch for enabling the turning ON and OFF cycle of the triggering switching means to be repeated in a given period of time during which the electric current flowing through the coil of the electromagnet is gradually reduced in its level.

BRIEF DESCRIPTION OF THE DRAWINGS

Embodiments of the invention will be described, by way of example only, with reference to the following drawings in which.

like numbers refer to like parts in different views, and in which.

DETAILED DESCRIPTION OF THE INVENTION

Figure 1:
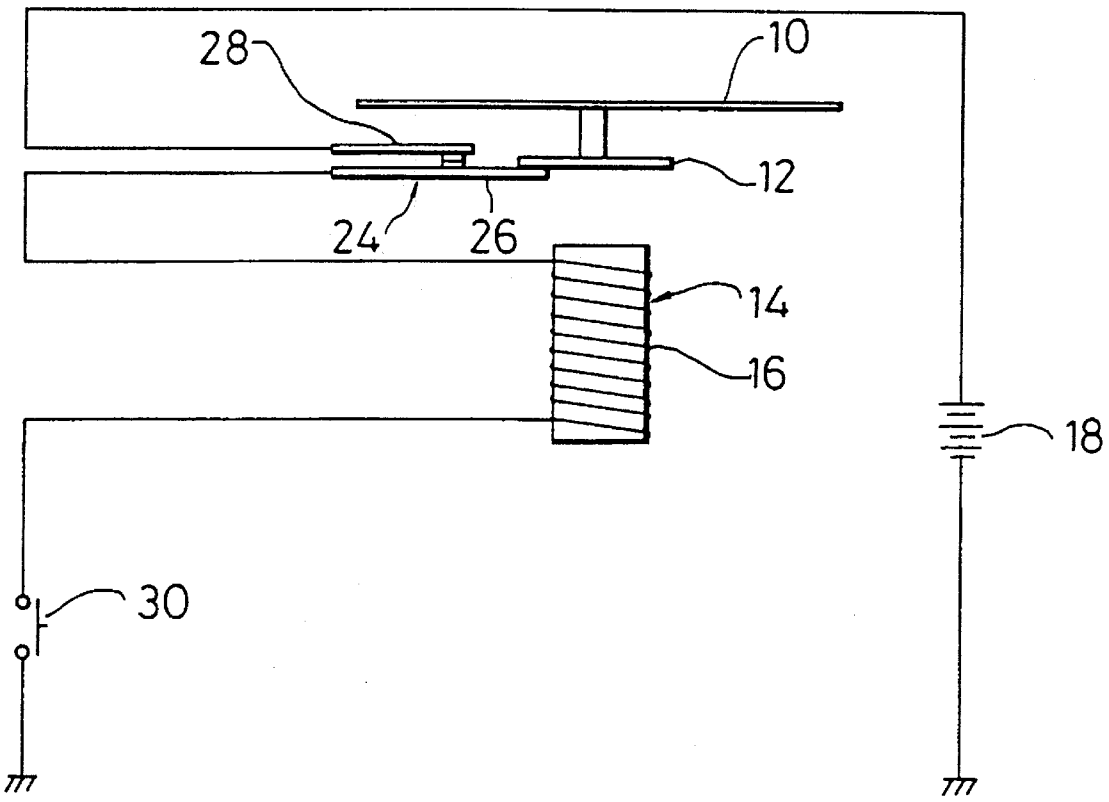
FIG. 1 PRIOR ART
FIG. 1 shows a typical electric horn of a prior art.
Figure 2:
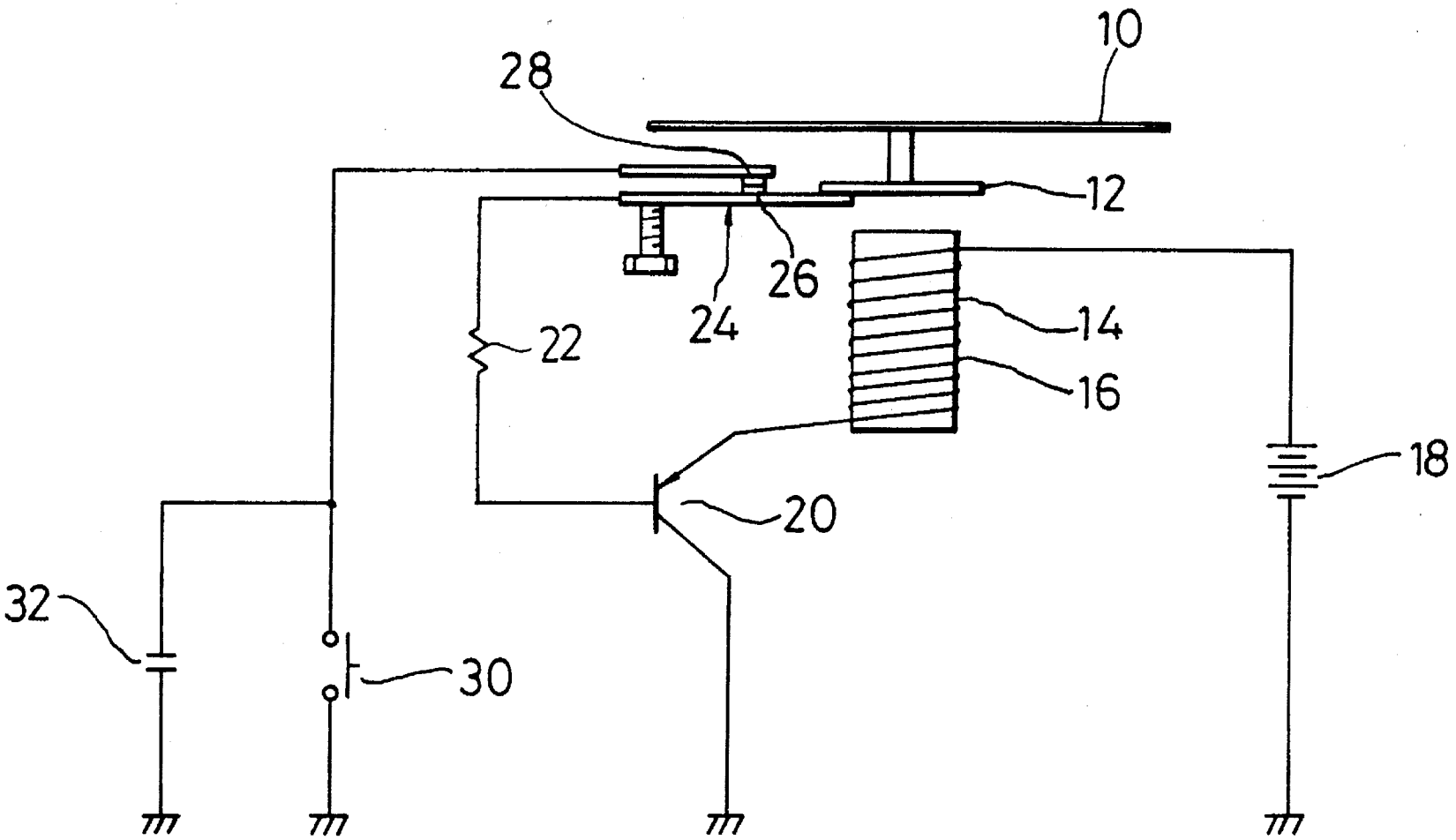
FIG. 2 is an embodiment illustrating a sparking free circuit of a preferred electric horn in accordance with the present invention.

Referring now to FIG. 2, there is shown an electric horn according to a preferred embodiment of the present invention, which comprises a diaphragm 10 firmly held at its peripheral portion in a housing of the horn(not shown), an armature 12 attached to a middle portion of the diaphragm 10, and an electromagnet 14 having a coil 16 and located opposite the armature 12 for drawing down the armature 12 when it is energized.

The coil 16 serves to energies the electromagnet 14. One end of the coil 16 is connected to the positive terminal of a battery 18, while the negative terminal of the battery 18 is grounded. The emitter of a PNP transistor 20 so called a triggering switching element is connected to the other end of the coil 16 of the electromagnet 14. The collector of the transistor 20 is connected to ground, and the base of the transistor 20 is connected, through a current limiting resistor 22, to a movable contact 26 of a normally-closed interrupter 24 positioned adjacent to the armature 12. The movable contact 26 is engaged with the armature 12.

A horn actuating switch 30 is at its one end connected to a fixed contact 28 of the interrupter 24 which is arranged in an opposite relationship with respect to the movable contact 26. The other end of the horn actuating switch 30 is connected to ground. The horn end of the horn actuating switch 30 is positioned within a steering wheel(not shown). Normally-opened contacts of the horn actuating switch 30 is subjected to an external manual actuating pressure.

A capacitor 32 connected in parallel with the horn actuating switch 30 and begins to charge at time when the horn actuating switch 30 is opened.

In operation, closing of the horn actuating switch 30 causes an electric current to flow from the battery 18 to the PNP transistor 20, the current limiting resister 22, the contacts 26, 28 of the interrupter 24, and the horn actuating switch 30, thereby turning ON the transistor 20.

When the transistor 20 is ON, a closed loop is formed by the battery 18, the coil 16 of the electromagnet 14 and the emitter-collector of the transistor 20, thereby causing an energizing current supplied to the coil 16 the electromagnet 14.

Accordingly, a magnetic field is generated around the electromagnet 14 by the energizing field is generated around the electromagnet 14 by the energizing current flowing through the coil 16 of the electromagnet 14 to thereby move the armature 12 toward the electromagnet 14. Such movement of the armature 12 causes the movable contact 26 and the fixed contact 28 of the interrupter 24 to open, thereby turning OFF the transistor 20. This enables one electromagnet 14 to be de-energized, and thus, allows the armature 12 to move up from the electromagnet 14 by the spring action of the diaphragm Return of the armature 12 allows the contacts 26, 28 of the interrupter 24 to close again. The energizing current is resupplied to the coil 16 and the cycle is repeated.

When the horn actuating switch 30 is opened, the capacitor 32 begins to charge. Charging of the capacitor 32 enables the turning ON and OFF cycle of the transistor 20 to be repeated in a given period of time. In this period, the exciting current flowing through the coil 16 of the electromagnet 14 is gradually reduced current will weaken the intensity of the vibration of the diaphragm, thereby providing gradually lowering sound in its volume.

Figure 3:
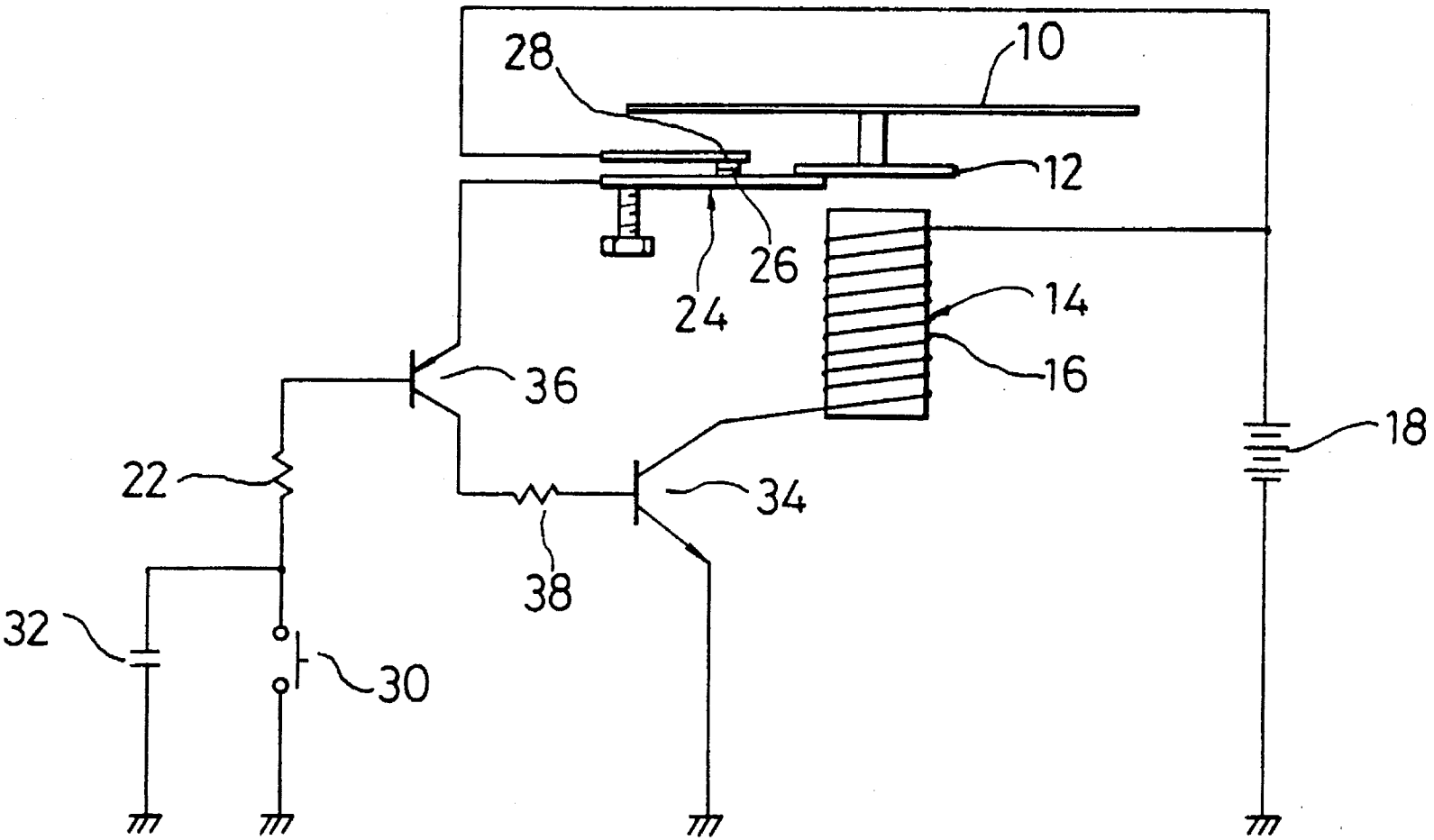
FIG. 3 is another embodiment illustrating a sparking free circuit of an electric horn in accordance with the present invention.

FIG. 3 shows another embodiment of the present invention wherein an NPN transistor of the NPN transistor 34 is connected to the other end of the coil 16 of the electromagnet 14 and the emitter thereof is connected to ground.

In addition, the collector of a PNP transistor 36 is connected to the base of the NPN transistor 34 through a second current limiting resistor 38. The emitter of the interrupter 24. The fixed contact 28 of the interrupter 24 is commonly connected to the positive terminal of the battery 18 and one end of the coil 16. The base of the PNP transistor 36 is commonly connected to one end of the horn actuating switch 30 and the positive terminal of the capacitor 32 through the first current limiting resistor 22.

In operation, closing of the horn actuating switch 30 causes an electric current to flow from the battery 18 to ground through the interrupter 24, the emitter-base of the PNP transistor 36, the first current limiting resistor 22 and the horn actuating switch 30, thereby turning ON the PNP transistor 36. Therefore, the PNP transistor 36 turns ON the NPN transistor 34, thereby enabling the electromagnet 14 to be energized. As a result, the energizing of the electromagnet 14 causes the armature 12 to move down toward the electromagnet 14. The interrupter 24 is opened to turn OFF the PNP transistor 36 because of the downward movement of the armature 12, thereby turning OFF the NPN transistor 34. This causes the electromagnet 14 to be de-energized and the armature 12 to return at its original position by the spring action of the diaphragm 10, thereby closing again the interrupter 24. As described in the first embodiment, after the horn switch 30 is opened, such cycles are repeated by the capacitor 32 in a given period of time.

Herein, it is noted that a sparking free circuit of an electric horn includes a transistor directly connected to a coil and a current limiting resistor connected to the transistor, so that the transistor serves to apply only its saturating voltage to a movable contact of an interrupter, and in the operation of the electric horn the vibration period of the interrupter is equal to the on-off one of the transistor, while the current resistor acts to limit the current flowing through the transistor, thereby removing the electric spark or arc produced between the mechanical contacts and the residual current introduced into a horn actuating switch. Therefore, the corrosion prohibition of the contacts and the reduction of the electronic noises enhance the performance of the electric horn. Although this invention has been shown and described with respect to the preferred embodiments, it will be apparent to those skilled in the art that certain changes and modifications may be made without departing from the spirit and scope of the invention as defined in the following claims.

I claim:

1. An electric horn for use in a vehicle, which comprises:

a diaphragm held at its peripheral portion in a housing of the horn and having an armature attached to a middle portion thereof;

an electromagnet having a coil and disposed adjacent to the armature in an opposed relationship with each other for causing the armature to move down under an action of a magnetic field produced by an energizing current flowing through the coil;

an interrupter having a pair of normally-closed contacts including a fixed contact and a movable contact and connected at one contact to a DC power source;

a horn actuating switch connected serially in circuit with the interrupter; and a sparking free circuit comprising:

a first electronic triggering switching means connected to the coil, for interrupting an energizing current supply to the coil of the electromagnet;

the normally-closed interrupter located near the armature and connected serially to a control input of the first electronic triggering switching means through a current limiting means, the normally-closed interrupter being for turning ON and OFF the first electronic triggering switching means, the movable contact engaging the armature so as to open the interrupter by the downward movement of the armature;

whereby upon interrupting the energizing current supply to the coil, the current limiting means limits a current flowing from the first electronic triggering switching means to the interrupter or the movable contacts.

2. The sparking free circuit of the electric horn of claim 1, wherein the first electronic triggering switching means is a PNP transistor; and the horn actuating switch is disposed between ground and the interrupter.

3. An electric horn for use in a vehicle, comprising:

a diaphragm held at its peripheral portion in a housing of the horn and having an armature attached to a middle portion thereof;

an electromagnet having a coil and disposed adjacent to the armature in an opposed relationship with each other for causing the armature to move in a downward movement toward the electromagnet under an action of a magnetic field produced by an energizing current flow through the coil:

an interrupter having a pair of normally-closed contacts including a fixed contact and a movable contact and connected at one contact to a DC power source:

a horn actuating switch connected serially in circuit with the interrupter:

a sparking free circuit comprising:

a first electronic triggering switching means connected to the coil, for interrupting the energizing current supply to the coil of the electromagnet;

the normally-closed interrupter located near the armature and connected serially to a control input of the first electronic triggering switching means through a current limiting means, for turning ON and OFF the first electronic triggering switching means, the movable contact engaging the armature so as to open the interrupter by the downward movement of the armature: and a second electronic triggering switching means connected between the interrupter and the first electronic triggering switching means for coupling and decoupling the interrupter to and from the control input of the first electronic triggering switching means, whereby, upon interrupting the energizing current supply to the coil, the current limiting means limits a current flowing from the first electronic triggering switching means to the interrupter or the movable contacts.

4. The spark free circuit of the electric horn of claim 3, wherein:

the first electronic triggering switching means is an NPN transistor;

the second electronic triggering switching means is a PNP transistor;

the horn actuating switch is connected between a control input of the second triggering switching means and ground;

a first current limiting resistor is connected between the control input of the second electronic triggering switching means and ground; and a second current limiting resistor is connected between the control input of the second electronic triggering switching and the control input of the first electronic triggering switching means.

5. The sparking free circuit of the electric horn of claim 3, further comprising a capacitor connected in parallel with the horn actuating switch and, so that upon opening of the horn actuating switch, the capacitor enables a turning ON and OFF cycle of the triggering switching means to be repeated in a given period of time during which the energizing current flowing through the coil is gradually reduced in amplitude.

6. An electric horn for use in a vehicle, which comprises:

a diaphragm held at its peripheral portion in a housing of the horn and having an armature attached to a middle portion thereof;

an electromagnet having a coil and disposed adjacent to the armature in an opposed relationship for causing the armature to move in a downward movement toward the electromagnet under an action of a magnetic field produced by an energizing current flow through the coil;

an interrupter having a pair of normally-closed contacts including a fixed contact and a movable contact and connected at one contact to a DC power source;

a horn actuating switch connected serially in circuit with the interrupter;

a sparking free circuit comprising:

a first electronic triggering switching means connected to the coil for interrupting the energizing current supply to the coil of the electromagnet;

the normally-closed interrupter located near the armature and connected to a control input of the first electronic triggering switching means, for turning ON and OFF the first electronic triggering switching means, the movable contact engaging the armature so as to open the interrupter by the downward movement of the armature; and a second electronic triggering switching means connected between the interrupter and the first electronic triggering switching means for coupling and recoupling the interrupter to and from the control input of the first electronic triggering switching means;

a first current limiting resistor connected between a control input of the second triggering switching means and ground;

a second current limiting resistor connected between the control input of the second triggering switching means and the control input of the first triggering switching means; and the horn actuating switch connected through the second current limiting resistor in the control input of the second electronic switching triggering means.

* * * * *